US006354354B1

(12) United States Patent
Schmidt

(10) Patent No.: US 6,354,354 B1
(45) Date of Patent: Mar. 12, 2002

(54) FILM FOR BLINDS AND PRODUCTION PROCESS

(76) Inventor: Manfred Schmidt, Schonaich (DE), 71101

( * ) Notice: Subject to any disclaimer, the term of this patent is extended or adjusted under 35 U.S.C. 154(b) by 795 days.

(21) Appl. No.: 08/624,091

(22) Filed: Mar. 29, 1996

(30) Foreign Application Priority Data

Apr. 13, 1995 (DE) ..... 195 14 019

(51) Int. Cl.[7] ..... E06B 3/38
(52) U.S. Cl. ..... 160/98; 160/84.04; 160/264
(58) Field of Search ..... 160/84.04, 238, 160/352, 98, 310, 23.1, DIG. 7, 264

(56) References Cited

U.S. PATENT DOCUMENTS

| | | | | | |
|---|---|---|---|---|---|
| 2,055,511 | A | * | 9/1936 | Twiss | 160/313 X |
| 2,328,263 | A | * | 8/1943 | De Stefano | 160/370.22 |
| 2,874,611 | A | * | 2/1959 | Luboshez | 160/84.04 X |
| 3,186,473 | A | * | 6/1965 | Myers et al. | 160/98 X |
| 3,195,616 | A | * | 7/1965 | Taber | 160/238 |
| 4,264,664 | A | * | 4/1981 | Kunz | 160/238 X |
| 4,649,980 | A | * | 3/1987 | Kunz | 160/98 |
| 4,807,684 | A | * | 2/1989 | Melton | 160/310 |
| 4,809,760 | A | * | 3/1989 | Lew | 160/238 |
| 4,848,437 | A | * | 7/1989 | Laniado et al. | 160/238 X |
| 4,944,341 | A | * | 7/1990 | Trippner et al. | 160/98 |
| 5,547,006 | A | * | 8/1996 | Auger | 160/238 X |
| 5,603,368 | A | * | 2/1997 | Colson et al. | 160/238 X |

FOREIGN PATENT DOCUMENTS

| | | | | |
|---|---|---|---|---|
| DE | 691030 | * | 4/1940 | 160/238 |
| DE | 2446203 | | 2/1976 | |
| DE | 3045883 | | 7/1982 | |
| EP | 0154218 | | 9/1985 | |
| EP | 0280007 | | 8/1988 | |
| EP | 0483528 | | 5/1992 | |

* cited by examiner

*Primary Examiner*—Blair M. Johnson
(74) *Attorney, Agent, or Firm*—Sughrue Mion, PLLC

(57) ABSTRACT

A film for blinds may be located either in front of a window pane in the conventional configuration or in the space between the panes in the case of a window with multiple glazing in order to provide decoration or shade. The film for blinds has creases which, due to their flexural moment, form a wave profile in the section of the blind that has been unwound, while they form a specific cross-section in the section that has been wound up. The blind winds up neatly and evenly with the layers exactly on top of each other, even when there are many layers and small winding diameters are involved.

1 Claim, 2 Drawing Sheets

FILM FOR BLINDS AND PRODUCTION PROCESS

BACKGROUND OF THE INVENTION

The invention relates to a film for blinds, the particular purpose of which is to act as a movable cover for panes of glass, as well as to a process for production of the same.

Blinds for darkening, shading or decorating windows have already been disclosed in the past. In their basic form they consist of a rotating roller located at the top to wind the actual blind either up or down, the bottom end of the blind being stabilised and weighted by a stiffening element such as a rod. The material used for the blind can, for example, be a 0.3 mm thick film, while the roller has a diameter of 30 mm. In the case of manually actuated blinds, a cord of some sort is generally attached to the end stiffening element and the roller is driven by a spring-loaded device. In the case of electric blinds, the drive generally act; on the roller.

Specially designed blinds can also act as movable heat protection for windows, house facades or solar collectors with a view to controlling the heat flow. DT 2446203, for example, proposes a solution for the thermal protection of windows and suitable protective films are described in EP 0483528A1. They generally consist of a thin plastic film laminated with copper or aluminium in such a way that they are, for example, semi-transparent to light but still reflect heat radiation almost completely. Their conventional internal location does, however, cause problems, because a window pane located behind the heat protection film forms condensation and steams up in cold weather.

The potential application for automatically controlled blinds with windows and house facades in particular have, for example, been investigated by the Fraunhofer Institute for Solar Energy Systems in Freiburg im Breisgau/Germany. The results show that they help to save considerable amounts of heating energy and that solar energy can be exploited with them. One of the systems disclosed makes use, for example, of specially designed windows in which a heat-effective blind is located between panes of glass. It is, however, a rather laborious and costly process to produce and assemble such windows, so that they do not satisfy market requirements.

Since the overwhelming majority of windows nowadays are fitted with double (or triple) glazing, it is a logical solution to locate blinds in the space between the panes of glass. Extremely compact blinds with a depth of only 16 to 22 mm are, however, required for this purpose. Proposals for solutions can be found, for example, in the patents EP 0154218A2 and EP 0483528A1 and products of this kind are also available on the market. They do, however, have their shortcomings, which are quite considerable in some cases. It can even be observed that demonstration models at trade fairs, shows and exhibitions are sometimes fitted with protective films that wind up crookedly, form wrinkles, do not hang straight or even stick to the pane of glass. It is evident that the technical problems which arise with an extremely compact blind have not yet been solved fully satisfactorily.

SUMMARY OF THE INVENTION

The objective of the invention is to create a blind that does not have the shortcomings and disadvantages outlined above, that is suitable for installation between the panes of windows with double (or triple) glazing and that can be produced inexpensively.

This objective is achieved by a film for blinds and a process for production of the same in accordance with claim 1.

A film for blinds in accordance with the invention has creases at an angle of up to 180 degrees that extend in the same direction parallel to the winding axis of the blind. Due to their flexural moment, these creases lead to the formation of a wave profile, that in turn forms a roll with a cross-section similar in shape to a sprocket wheel and with its own torque when the blind is wound up and all the layers are resting directly on top of each other. A film for blinds that is designed in this way has a number of outstanding properties, the most important of which are listed below:

1. The blind winds up tidily and accurately because the layers rest directly on top of each other when the blind has been rolled up.
2. The crease torque facilitates the blind winding operation.
3. The wave profile helps to increase transverse stiffness.
4. A cushion of air is formed, which stops the blind sticking to the pane of glass.

A blind consisting of the film for blinds in accordance with the present invention and a winding mechanism can be used for the conventional purpose of decorating or shading windows. In such cases the film for blinds can be produced from materials and by processes that are used for pleated blinds. As is generally known, such pleated blinds have narrow folds in a zigzag pattern similar to the equidirectional creases required in the film for blinds. It is possible to produce these creases in a simple way by a special process, in the course of which a round roll is formed into a flattened roll.

When the blind is used for heat protection purposes, the preferred location is between the panes of windows with double (or triple) glazing. In view of the protected location, the film for blinds can be designed to be extremely thin and light, with the advantage that the capacity of the drive provided to wind up and unwind the blind only needs to be very small. Practical experience to date has shown that a battery-driven electric motor with a capacity of 0.3 W is sufficient to drive such a blind. The low power requirement means that the blind can also be actuated by a magnetic device that transmits force or torque from the outside to the inside through one of the panes of glass to move the blind. In a preferred embodiment, the blind is actuated manually in the space between panes of glass by moving the magnetic device. The magnetic device can of course also be used to transmit force in the case of an electric drive located externally.

BRIEF DESCRIPTION OF THE DRAWINGS

Further advantages, features and potential applications for the present invention can be found in or deduced from the subordinate claims and the following description, in connection with these drawings:

DETAILED DESCRIPTION OF THE INVENTION

Figure 1:
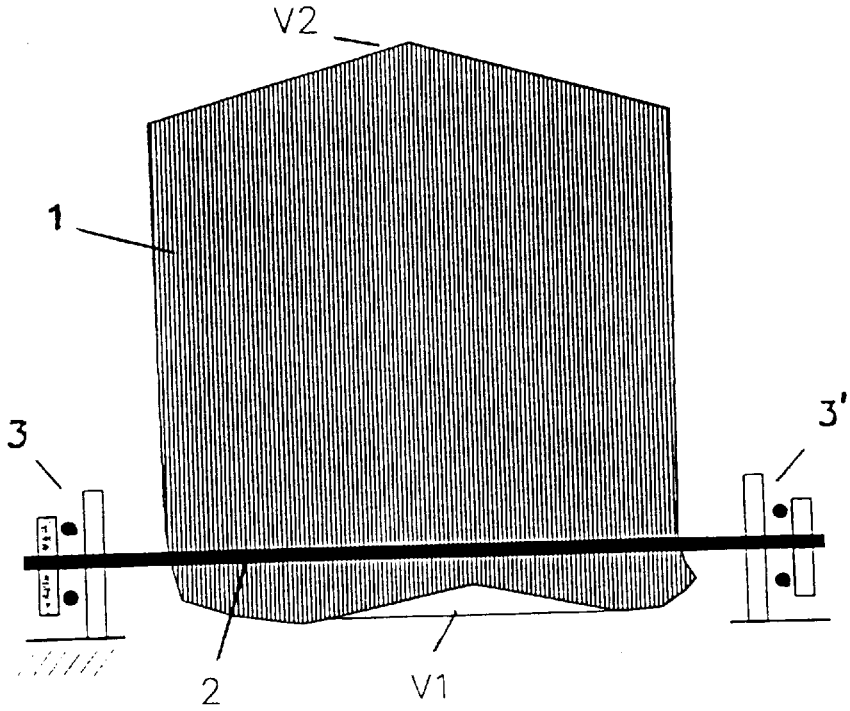
FIG. 1 shows a process for production of the film for blinds.
Figure 1:
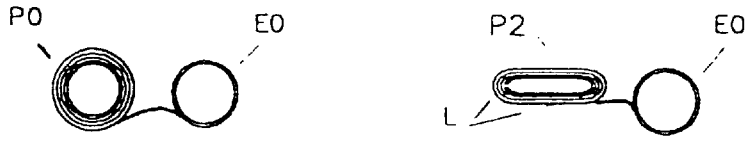

FIG. 1 shows a special process for production of the film for blinds from a film 1 in accordance with the present invention. The film 1 is preferably made from plastic that can be formed at a specific temperature of, for example, 120° C. Suitable materials with the necessary heat-effective and visual properties are available on the market.

In a first operation, the film 1 is wound onto a mandrel 2, which has a minimum diameter of about 6 mm. This mandrel is clamped firmly between two axial bearings 3, 3' to give it the stability it needs for the winding process. To make it easier to wind up the film 1, the latter is cut at an obtuse angle into the shape of an arrow on the side that is to be wound up (V1 and V2). The second cut V2 is required for a special end stiffening element E0, which is formed by winding up this side.

When both sides have been wound up, the film 1 has the form of two rolls, the round roll P0 and the end stiffening element E0. The roll for the end stiffening element E0 consists, for example, of 10 layers, that are turned into a homogeneous tube by gluing, welding or a similar process. The mandrel 2 that is used to carry out the winding operation in each case is preferably a thin-walled tube; it can either remain inside the roll or it can be removed for reuse.

In a second operation, the round roll P0 is pressed together to form a flattened roll P2 either with the mandrel 2 still inside it or after the mandrel has been removed. In the course of this operation, creases L with an angle of 180 degrees are formed at the two ends. These creases are made permanent in the material preferably by temporary heating during or after the pressing operation. The end stiffening element E0 can also be creased as a round roll in the same way. The formation of the creases L by making the flattened roll P2 is the central operation in the production of the film for blinds in accordance with the present invention.

The process for production of the end stiffening element E0 can be varied in many different ways.

Figure 2:
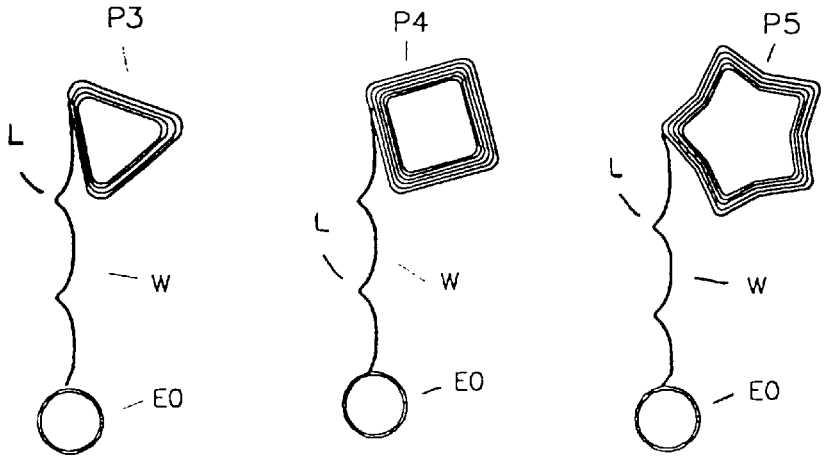
FIG. 2 shows three embodiments of the film for blinds.

Three embodiments of the finished film for blinds are illustrated in FIG. 2. They are produced by unwinding the flattened roll P2 and winding the film up again into a roll, either with a triangular profile P3, a square profile P4, a pentagonal profile P5 or a different profile with more sides. The flexural moments of the creases L resting on top of each other stabilize the profile concerned and generate torque in the winding direction. The triangular profile P3 is generally suitable for small winding diameters, while the pentagonal profile P5 is suitable for large winding diameters. The creases L cause the unwound section to adopt a wave profile W. A minimum of tensile force is required to bring about this effect, corresponding approximately to the weight of the end stiffening element E0.

Figure 3:
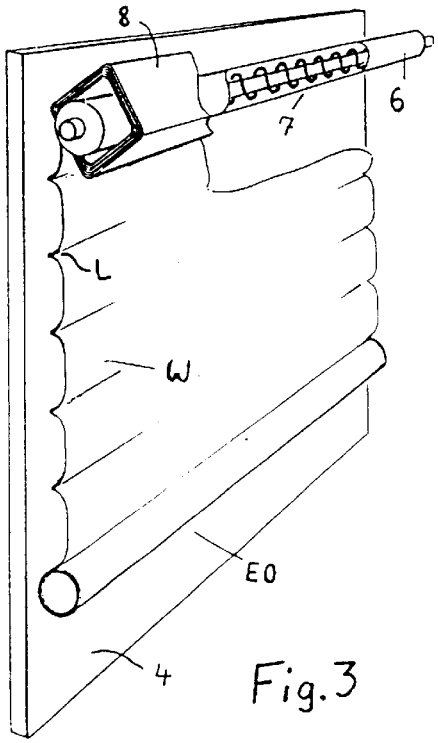
Fig. 3 shows a film for blinds with a spring drive inside the winding roller.

FIG. 3 is a diagram showing how the film for blinds is used as the moving cover for a pane of glass 4. The wave profile W stiffens the film for blinds transversely and forms a cushion of air between it and the pane of glass 4, which improves the thermal insulation and stops the film for blinds from sticking to the glass. The edge profile of the roll 8 is designed to make sure that the blind is wound up neatly and evenly with the layers exactly on top of each other, even when there are many layers and small diameters are involved.

Parts of a winding mechanism in the form of a winding tube 6, inside which a torsion spring 7 is located, are also shown. The winding tube 6 in the illustration is round, but it could also have the shape of a square tube to match the roll 8. The torsion spring 7 located inside the tube effectively compensates for the tensile forces exerted by the film for blinds and produces the torque needed to wind the blind up. A drive unit for actuating the blind can either act on the winding tube 6 to wind the blind up or it can move the end stiffening element E0 to unwind the blind, while the film for blinds winds up or unwinds in accordance with this movement, depending on the force exerted by the spring.

In a special version suitable for installation inside windows with double (or triple) glazing, the diameter of the winding tube 6 is only about 7 mm and the film for blinds is 0.02 mm thick. The gauge of the wire used for the torsion spring 7 is about 0.3 mm and is coiled 140 times. Practical experience to date has shown that the film for blinds can be up to about 120 cm wide and 150 cm long with such a spring. The diameter of the roll 8 is about 15 mm when the blind is 80 cm long and 21 mm when it is 150 cm long. The capacity of the drive needs to be about 0.1 W in order to actuate the blind.

Figure 4:
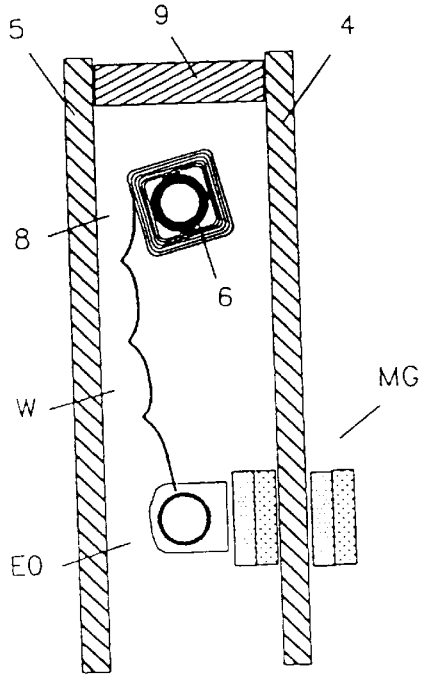
FIG. 4 shows a manually actuated blind inside a double-glazed window.

FIG. 4 is a cross-section of a double-glazed window which has a manually actuated blind inside it. The double-glazed window consists of two panes 4 and 5, that are attached to each other securely by a spacing element 9. The film for blinds is pivoted on a winding tube 6 with a spring drive in accordance with the example shown in FIG. 3. A magnetic device MG transmits force through the pane of glass 4 to move the end stiffening element E0. It is evident that the film for blinds can be wound up or down manually by moving the magnetic device MG. The advantages of this solution are that it is inexpensive to produce and is highly reliable.

Figure 5:
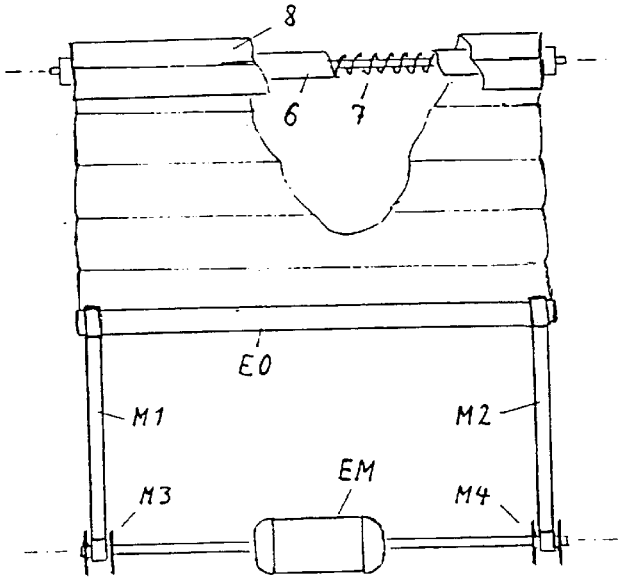
FIG. 5 shows an electrically actuated blind inside a double-glazed window.

FIG. 5 shows a blind that is actuated by an unwinding drive in the form of an electric motor EM. The film for blinds is pivoted on a winding tube 6 with a torsion spring 7 in accordance with the example shown in FIG. 3. Pulling elements M1, M2, that are wound up or down on reels M3, M4 and thus actuate the blind, engage the end stiffening element E0. The pulling elements M1, M2 are preferably steel strips about 0.05 mm thick; the reels M3, M4 share a shaft that is driven by the electric motor EM. If appropriate dimensions are chosen, this version of the invention can be located in the space between the two panes of a double-glazed window as outlined above. For this application the diameter of the electric motor EM is about 12 mm and its capacity is 0.3 W.

What is claimed is:

1. An extendible and retractable blind in combination with a multiple-glazed window comprising a multiple-glazed window having at least two parallel spaced apart panes of glass hermetically sealed to each other to define an interior space between said panes of glass, a blind comprised of a film having a plurality of spaced apart parallel creases extending from one side edge of the film to an opposite side edge of the film, a multi-sided mandrel upon which said film is wound, support means for rotatably supporting said mandrel within said space between said panes of glass, spring means operatively connected to said support means for rotating said support means in the winding direction of said film, an electric motor mounted within said space in spaced relation to said support means and connecting means operatively connected between said electric motor and one end of said film for unwinding said film from said mandrel upon operation of said motor, wherein said film has a thickness between 0.01 and 0.05 mm and said creases are provided at an interval of 7–20 mm.

* * * * *